US012759686B2

(12) United States Patent
Gao et al.

(10) Patent No.: US 12,759,686 B2
(45) Date of Patent: Oct. 13, 2026

(54) TILLERS FOR MARINE DRIVES HAVING YAW ADJUSTMENT DEVICE

(71) Applicant: Brunswick Corporation, Mettawa, IL (US)

(72) Inventors: Jessie Gao, Suzhou Industrial Park (CN); Scott G. Ahlswede, Plymouth, WI (US); Gary D. Needham, Stillwater, OK (US); Robert A. Podell, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 331 days.

(21) Appl. No.: 18/582,769

(22) Filed: Feb. 21, 2024

(65) Prior Publication Data

US 2025/0256823 A1 Aug. 14, 2025

(30) Foreign Application Priority Data

Feb. 8, 2024 (CN) ..... 202420291910.9

(51) Int. Cl.
*B63H 20/12* (2006.01)
*B63H 20/16* (2006.01)

(52) U.S. Cl.
CPC ..... *B63H 20/12* (2013.01); *B63H 20/16* (2013.01)

(58) Field of Classification Search
CPC ..... B63H 20/00; B63H 20/12; B63H 20/16; B63H 21/00; B63H 21/21; B63H 21/213
USPC ..... 114/144 R
See application file for complete search history.

(56) References Cited

U.S. PATENT DOCUMENTS

| | | | |
|---|---|---|---|
| 1,854,196 | A | 4/1932 | Irgens |
| 2,363,854 | A | 11/1944 | Bierenfeld |
| D188,325 | S | 7/1960 | Brown |
| 3,018,754 | A | 1/1962 | Snyder et al. |
| 3,636,911 | A | 1/1972 | Piazza |
| 3,693,576 | A | 9/1972 | Driscoll |
| 3,865,334 | A | 2/1975 | Wair, Jr. |
| 3,955,527 | A | 5/1976 | Holtermann |
| 3,961,595 | A | 6/1976 | Meyer |
| D246,853 | S | 1/1978 | Berchem |
| 4,071,002 | A | 1/1978 | Frahm |

(Continued)

FOREIGN PATENT DOCUMENTS

| | | |
|---|---|---|
| AU | 2019100942 | 9/2019 |
| CA | 2367740 | 7/2002 |

(Continued)

OTHER PUBLICATIONS

Belter, U.S. Appl. No. 18/047,360, filed Oct. 18, 2022, "Configurable Shift and Throttle Mechanism for Tiller of Marine Drive" (specification and drawings only).

(Continued)

*Primary Examiner* — Lars A Olson
(74) *Attorney, Agent, or Firm* — Andrus Intellectual Property Law, LLP

(57) ABSTRACT

A tiller is for steering a marine vessel. The tiller has a yaw bracket configured for attachment to a marine drive, a tiller arm which is pivotable about a yaw axis relative to the yaw bracket, and a yaw lock configured to lock the tiller arm in a plurality of yaw positions relative to the yaw bracket. Unlocking the yaw lock facilitates movement of the tiller arm into a new yaw position in the plurality of yaw positions.

20 Claims, 7 Drawing Sheets

(56) References Cited

U.S. PATENT DOCUMENTS 4,295,835 A 10/1981 Mapes et al.
4,318,699 A 3/1982 Wenstadt et al.
4,331,431 A 5/1982 Estes
D272,357 S 1/1984 Hall et al.
4,447,214 A 5/1984 Henrich
D276,811 S 12/1984 Wolfe
4,496,326 A 1/1985 Boda
4,504,778 A 3/1985 Evans
4,521,201 A 6/1985 Watanabe
4,582,493 A 4/1986 Toyohara
4,650,429 A 3/1987 Boda
4,701,141 A 10/1987 Sumigawa
D295,867 S 5/1988 Walsh
4,800,854 A 1/1989 Boda et al.
4,838,820 A 6/1989 Boda et al.
4,878,468 A 11/1989 Boda et al.
4,895,154 A 1/1990 Bartelt
4,897,061 A 1/1990 Koepsel et al.
4,911,665 A 3/1990 Hetzel
5,072,809 A 12/1991 Shibata
D323,508 S 1/1992 Hirshberg et al.
5,145,427 A 9/1992 Kawai et al.
D332,265 S 1/1993 Osumi
5,180,320 A 1/1993 Calamia et al.
D341,365 S 11/1993 Little et al.
D343,625 S 1/1994 Walthall
5,277,634 A 1/1994 Calamia et al.
5,279,242 A 1/1994 Johnson
5,340,342 A 8/1994 Boda et al.
D352,723 S 11/1994 DeBraal et al.
5,378,178 A 1/1995 Haman
D359,290 S 6/1995 Takeuchi
5,509,836 A 4/1996 Ogasawara et al.
5,540,606 A 7/1996 Strayhorn
D373,113 S 8/1996 Stringer
5,632,657 A 5/1997 Henderson
D380,478 S 7/1997 Robbins
D387,775 S 12/1997 Iekura
5,707,262 A 1/1998 Huntley et al.
5,756,949 A 5/1998 Sato
5,797,777 A 8/1998 Tsunekawa et al.
D412,911 S 8/1999 Iekura
5,967,866 A 10/1999 Willows et al.
D416,871 S 11/1999 Todd
D418,519 S 1/2000 Iekura
6,020,563 A 2/2000 Risk, Jr. et al.
D421,444 S 3/2000 Hatch et al.
D428,616 S 7/2000 Iekura
6,093,066 A 7/2000 Isogawa et al.
6,109,986 A 8/2000 Gaynor et al.
6,146,221 A 11/2000 Natsume
6,174,211 B1 * 1/2001 Nakamura ..... B63H 20/12 114/172
D438,493 S 3/2001 Mulliniks et al.
6,264,513 B1 7/2001 Marsh
6,264,516 B1 7/2001 McEathron et al.
D447,123 S 8/2001 Winkler
6,273,771 B1 8/2001 Buckley et al.
D448,037 S 9/2001 Westimayer et al.
6,352,456 B1 3/2002 Jaszewski et al.
D457,166 S 5/2002 Burmeister et al.
6,382,122 B1 5/2002 Gaynor et al.
D458,273 S 6/2002 Burmeister et al.
6,406,342 B1 6/2002 Walczak et al.
6,406,343 B2 6/2002 Kawai et al.
D460,459 S 7/2002 Hansen
D460,465 S 7/2002 Williams
D460,972 S 7/2002 Osumi
D462,363 S 9/2002 Burmeister et al.
D463,447 S 9/2002 Osumi et al.
D463,448 S 9/2002 Osumi
D463,449 S 9/2002 Osumi
D463,800 S 10/2002 Osumi
D466,907 S 12/2002 Ohsumi
6,494,431 B1 12/2002 McCoy
D470,154 S 2/2003 Burmeister et al.
6,524,148 B2 2/2003 Yoshigasaki et al.
D474,480 S 5/2003 Zebley, Jr. et al.
D474,784 S 5/2003 Sanschagrin et al.
6,558,213 B1 5/2003 McGowan
D478,597 S 8/2003 Zebley, Jr.
6,648,703 B2 11/2003 McChesney et al.
6,663,450 B1 12/2003 Walczak et al.
D485,847 S 1/2004 Sanschagrin et al.
D485,848 S 1/2004 Sanschagrin et al.
D486,500 S 2/2004 Okamoto
6,715,438 B1 4/2004 Hundertmark
D489,380 S 5/2004 Ohsumi et al.
D495,345 S 8/2004 Farlow et al.
D495,716 S 9/2004 Sanschagrin et al.
D497,370 S 10/2004 Katoh
D498,485 S 11/2004 Kuwae
D498,764 S 11/2004 Sanschagrin et al.
D500,056 S 12/2004 DeYoung
6,875,066 B2 4/2005 Wolaver
6,902,450 B2 6/2005 Ohtsuki et al.
6,914,202 B2 7/2005 Sugimoto et al.
7,001,231 B1 2/2006 Halley et al.
D517,096 S 3/2006 Landers et al.
7,090,551 B1 8/2006 Lokken et al.
D527,737 S 9/2006 Lekura
D528,128 S 9/2006 Sanschagrin et al.
D528,563 S 9/2006 Sanschagrin et al.
D531,639 S 11/2006 Okamoto
D531,640 S 11/2006 Okamoto
D536,704 S 2/2007 Iekura
D537,838 S 3/2007 Iekura
7,210,973 B2 5/2007 Sanschagri et al.
7,214,113 B2 5/2007 Kojima
D549,240 S 8/2007 Okamoto
7,267,592 B1 9/2007 Ingebritson et al.
D552,129 S 10/2007 Steinberg
D552,130 S 10/2007 Steinberg et al.
D560,050 S 1/2008 Tokach et al.
D563,907 S 3/2008 Badarello
D565,607 S 4/2008 Moen et al.
7,404,747 B2 7/2008 Shinde et al.
D578,274 S 10/2008 Tokach et al.
7,442,104 B2 10/2008 Okabe
7,455,558 B2 11/2008 Yander
D584,317 S 1/2009 Okamoto
D589,981 S 4/2009 Iekura
7,553,206 B2 6/2009 Hasegawa et al.
7,666,038 B2 2/2010 Yomo et al.
D611,062 S 3/2010 Okamoto
D611,063 S 3/2010 Okamoto
D611,501 S 3/2010 Vignau et al.
D611,502 S 3/2010 Vignau et al.
7,677,938 B2 3/2010 Wiatrowski et al.
7,704,110 B2 4/2010 Wiatrowski et al.
7,736,207 B2 6/2010 Vignau
D623,661 S 9/2010 Yamagishi et al.
D624,567 S 9/2010 Kelley
D626,975 S 11/2010 Ryczek et al.
D629,818 S 12/2010 Rummer et al.
D635,154 S 3/2011 Rummer et al.
7,895,959 B1 3/2011 Angel et al.
D635,586 S 4/2011 Okamoto
7,976,354 B2 7/2011 Kubota et al.
D643,440 S 8/2011 Dannenberg et al.
8,106,617 B1 1/2012 Holley
D655,308 S 3/2012 Steinberg
D655,320 S 3/2012 Hiraoka et al.
D657,400 S 4/2012 Loew
D660,323 S 5/2012 Hiraoka et al.
D660,614 S 5/2012 Palmeiri
D663,321 S 7/2012 Okamoto
8,257,122 B1 9/2012 Holley
8,651,906 B1 2/2014 Morton
D706,313 S 6/2014 Higashikawa et al.
D707,729 S 6/2014 Jackson et al.
D708,233 S 7/2014 Furuki et al.
D709,918 S 7/2014 Jones, Sr.
D712,931 S 9/2014 Matsumoto

(56) References Cited

U.S. PATENT DOCUMENTS

| | | | |
|---|---|---|---|
| D714,345 | S | 9/2014 | Petit et al. |
| D715,333 | S | 10/2014 | Jacobsthal et al. |
| D716,846 | S | 11/2014 | Carter et al. |
| 8,930,050 | B2 | 1/2015 | Garon et al. |
| D727,969 | S | 4/2015 | Okamoto |
| 9,004,964 | B2 | 4/2015 | Grez |
| D728,640 | S | 5/2015 | Turner et al. |
| 9,039,469 | B1 | 5/2015 | Calamia et al. |
| 9,073,616 | B1 | 7/2015 | Wiegele et al. |
| 9,109,616 | B1 | 8/2015 | Ballentine |
| D740,858 | S | 10/2015 | Dannenberg et al. |
| 9,180,950 | B1 | 11/2015 | Davenport et al. |
| 9,205,906 | B1 | 12/2015 | Eichinger |
| 9,216,805 | B1 | 12/2015 | Amerling et al. |
| D757,126 | S | 5/2016 | Vaninetti et al. |
| 9,359,059 | B1 | 6/2016 | Scherer, III et al. |
| 9,359,981 | B1 | 6/2016 | Waisanen et al. |
| 9,376,194 | B1 | 6/2016 | Jensen et al. |
| 9,422,045 | B2 | 8/2016 | Kinpara et al. |
| 9,481,438 | B1 | 11/2016 | Tuchscherer |
| 9,580,947 | B1 | 2/2017 | Amerling et al. |
| 9,587,601 | B1 | 3/2017 | Ochiai |
| D791,189 | S | 7/2017 | Scherer, III et al. |
| 9,694,892 | B1 | 7/2017 | Anschuetz et al. |
| 9,701,383 | B1 | 7/2017 | Stuber et al. |
| D794,078 | S | 8/2017 | Vaninetti |
| D794,079 | S | 8/2017 | Vaninetti et al. |
| 9,764,813 | B1 | 9/2017 | Zarembka et al. |
| 9,783,278 | B1 | 10/2017 | Dannenberg et al. |
| 9,789,945 | B1 | 10/2017 | Vaninetti et al. |
| 9,840,316 | B1 | 12/2017 | Jaszewski |
| D806,752 | S | 1/2018 | Vaninetti et al. |
| D807,920 | S | 1/2018 | Vaninetti |
| D809,017 | S | 1/2018 | Noda et al. |
| 9,868,501 | B1 | 1/2018 | Gable et al. |
| 9,926,064 | B1 | 3/2018 | Tuchscherer |
| D816,716 | S | 5/2018 | Abellera et al. |
| D832,472 | S | 10/2018 | Davis et al. |
| D834,617 | S | 11/2018 | Zin et al. |
| D834,618 | S | 11/2018 | Zin et al. |
| D835,675 | S | 12/2018 | Nakaura et al. |
| 10,155,578 | B1 | 12/2018 | Osthelder et al. |
| D842,504 | S | 3/2019 | Davis et al. |
| 10,246,173 | B1 | 4/2019 | Ingebritson |
| D852,230 | S | 6/2019 | Zin et al. |
| D852,848 | S | 7/2019 | Zin et al. |
| D852,849 | S | 7/2019 | Zin et al. |
| D852,850 | S | 7/2019 | Zin et al. |
| 10,343,759 | B2 | 7/2019 | Despineux |
| D859,469 | S | 9/2019 | Zin et al. |
| 10,507,898 | B1 | 12/2019 | Belter et al. |
| 10,578,042 | B2 | 3/2020 | Buis |
| D886,865 | S | 6/2020 | Bailey |
| 10,696,367 | B1 | 6/2020 | Ingebritson et al. |
| 10,723,429 | B1 | 7/2020 | Wiatrowski et al. |
| 10,787,236 | B1 | 9/2020 | Erickson et al. |
| D911,296 | S | 2/2021 | Li |
| 10,940,917 | B2 | 3/2021 | Montague et al. |
| D917,565 | S | 4/2021 | Vaninetti et al. |
| 10,981,639 | B2 | 4/2021 | Kimpara et al. |
| 11,046,411 | B2 | 6/2021 | Chung |
| 11,084,563 | B1 | 8/2021 | Pielow et al. |
| 11,097,824 | B1 | 8/2021 | Anderson, Jr. |
| 11,097,826 | B1 | 8/2021 | Dannenberg et al. |
| 11,180,235 | B2 | 11/2021 | Wiatrowski |
| 11,186,352 | B1 | 11/2021 | Erickson et al. |
| 11,352,118 | B1 | 6/2022 | Dengel et al. |
| 11,628,919 | B1 | 4/2023 | Pielow et al. |
| 12,391,351 | B2 | 8/2025 | Ahlswede |
| 12,403,994 | B2 | 9/2025 | Ahlswede |
| 12,528,571 | B1 | 1/2026 | Needham |
| 12,539,953 | B1 | 2/2026 | Belter |
| 12,545,385 | B2 | 2/2026 | Dannenberg |
| 12,545,387 | B2 | 2/2026 | Ahlswede |
| 12,570,384 | B2 | 3/2026 | Dannenberg |
| 2002/0142680 | A1 | 10/2002 | Anderson |
| 2003/0024456 | A1 | 2/2003 | Swetish |
| 2003/0176121 | A1 | 9/2003 | Kitsu |
| 2003/0194927 | A1 | 10/2003 | Sanschagrin et al. |
| 2003/0232548 | A1 | 12/2003 | Alby et al. |
| 2004/0107789 | A1 | 6/2004 | Peppard |
| 2004/0121667 | A1 | 6/2004 | Okabe |
| 2004/0137806 | A1 | 7/2004 | Ohtsuki et al. |
| 2005/0262958 | A1 | 12/2005 | Kojima |
| 2006/0172631 | A1 | 8/2006 | Kameoka |
| 2007/0042652 | A1 | 2/2007 | Kitsu et al. |
| 2007/0197109 | A1 | 8/2007 | Yander |
| 2008/0038967 | A1 | 2/2008 | Shinde |
| 2008/0268729 | A1 | 10/2008 | Yomo et al. |
| 2009/0075534 | A1 | 3/2009 | Wiatrowski et al. |
| 2010/0147257 | A1 | 6/2010 | Yazaki et al. |
| 2011/0104963 | A1 | 5/2011 | Ellis |
| 2013/0280970 | A1 | 10/2013 | Clarkson et al. |
| 2014/0057508 | A1 | 2/2014 | Litjens et al. |
| 2014/0306505 | A1 | 10/2014 | Koch |
| 2016/0023740 | A1 | 1/2016 | Skrzypchak et al. |
| 2017/0043787 | A1 | 2/2017 | Mangette et al. |
| 2017/0306830 | A1 | 10/2017 | Bruestle et al. |
| 2019/0176952 | A1 | 6/2019 | Clark et al. |
| 2020/0156751 | A1 | 5/2020 | Skrzypchak et al. |
| 2020/0172220 | A1 | 6/2020 | Chung |
| 2021/0061431 | A1 | 3/2021 | Mcginley |
| 2023/0102741 | A1 | 3/2023 | Fergus et al. |
| 2023/0257091 | A1 | 8/2023 | Ahlswede |
| 2023/0257092 | A1 | 8/2023 | Ahlswede et al. |
| 2023/0257093 | A1 | 8/2023 | Ahlswede et al. |
| 2023/0257094 | A1 | 8/2023 | Jaszewski et al. |

FOREIGN PATENT DOCUMENTS

| | | |
|---|---|---|
| EP | 1101696 | 5/2001 |
| EP | 1400720 | 3/2004 |
| EP | 3326903 | 4/2019 |
| JP | S60 38293 | 2/1985 |
| JP | 3946315 | 7/2007 |
| JP | 4094151 | 6/2008 |
| JP | 2011-213215 | 10/2011 |
| JP | 2013-173423 | 9/2013 |
| JP | 5741259 | 7/2015 |
| JP | 5927980 | 6/2016 |
| WO | WO 2004-035381 | 4/2004 |

OTHER PUBLICATIONS

Erikson, et al., "Tiller Tilt Lock and Automatic Release System", Unpublished U.S. Appl. No. 16/257,380, filed Jan. 25, 2019 (specification and drawings only) Issued as U.S. Pat. No. 10,787,236.

Fergus, et al., Unpublished U.S. Appl. No. 17/487,116. (published as US 2023-0102741 A1).

Jaszewski, et al., Unpublished U.S. Appl. No. 17/585,214. (published as US 2023-0257094 A1).

Mercury Marine, 15/20hp EFI Fourstroke Outboard Tiller, tiller handle, available at least as early as Nov. 17, 2017.

Mercury Marine, Big Tiller for 75-300 HP Mercury Outboards, tiller handle, available at least as early as 2018, admitted prior art.

Partial EP Search Report issued in European Patent Application No. 23156070.7, dated Jul. 14, 2023.

Partial EP Search Report issued in European Patent Application No. 23156071.5, dated Jul. 14, 2023.

Pielow et al., "Tiller for Outboard Motor," Unpublished U.S. Appl. No. 16/718,566, filed Dec. 18, 2019 (specification and drawings only) Issued as U.S. Pat. No. 11,084,563.

Vaninetti et al, "Tiller for Outboard Motor," Unpublished U.S. Appl. No. 29/610,556, filed Jul. 13, 2017.

Butler, Jeff. "New Mercury Electric Outboard Makes Big Debut in Miami." Plugboats, Feb. 22, 2022, available at: https://plugboats.com/new-mercury-electric-outboard-makes-big-debut-miami/ (last accessed Jun. 11, 2026).

Mercury Marine, "Mercury Live at MIBS—Electrification," YouTube (Feb. 17, 2022), available at https://www.youtube.com/watch?v=8kxTh8toTPI&t=263s (last accessed Jun. 11, 2026).

(56) References Cited

OTHER PUBLICATIONS

Mercury Marine. "First Look at the Mercury Avator Electric Outboard Concept." YouTube, published Feb. 16, 2022, available at: https://www.youtube.com/watch?v=9SOc4XffK70 (accessed Jun. 11, 2026).
Mercury Marine. "Mercury Announces First Concept of the Avator Electric Outboard Series." YouTube, published Feb. 16, 2022, available at: https://www.youtube.com/watch?v=f4X34c_v4sl (last accessed Jun. 11, 2026).
Office Action issued in U.S. Appl. No. 18/582,772, dated Jun. 3, 2026.

* cited by examiner

TILLERS FOR MARINE DRIVES HAVING YAW ADJUSTMENT DEVICE

CROSS-REFERENCE TO RELATED APPLICATION

The present application claims priority to Chinese Application No. 202420291910 9, filed Feb. 8, 2024, the content of which is incorporated herein by reference.

FIELD

The present disclosure relates to tillers for steering marine drives.

BACKGROUND

The following U.S. Patent is incorporated herein by reference in entirety.

U.S. Pat. Pub. No. 2023/0257092 is incorporated herein by reference and discloses a tiller for controlling a marine drive. The tiller has a base bracket assembly and a tiller arm which extends outwardly from the base bracket assembly. The base bracket assembly is configured to facilitate yaw adjustment of the tiller arm, in particular into and between a variety of yaw positions relative to the base bracket assembly. The tiller arm has a grip restraining device which is located on the bottom of the middle portion of the tiller arm and is manually accessible from both sides of the tiller arm. The grip restraining device is specially configured to selectively restrain rotation of a hand grip on the outer end of the tiller arm. The tiller arm also has a tilt mechanism which facilitates tilting of the tiller arm relative to the base bracket assembly into and between a variety of tilt positions, including a straight upward tilt position and a straight downward tilt position.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In independent examples disclosed herein, a tiller is for steering a marine drive relative to a marine vessel. The tiller includes a yaw bracket configured for attachment to the marine drive, a tiller arm which is pivotable about a yaw axis relative to the yaw bracket, and a yaw lock configured to lock the tiller arm in a plurality of yaw positions relative to the yaw bracket. Unlocking the yaw lock facilitates movement of the tiller arm into a new yaw position in the plurality of yaw positions.

In independent examples disclosed herein, the yaw lock is movable into a locked position in which the tiller arm is prevented from pivoting about the yaw axis relative to the yaw bracket. Further, the yaw lock is movable into an unlocked position in which the tiller arm is pivotable about the yaw axis relative to the yaw bracket.

In independent examples disclosed herein, in a locked position, the yaw lock clamps a first one of the yaw bracket and the tiller arm between a second one of the yaw bracket and the tiller arm, and in an unlocked position the yaw lock unclamps the first one of the yaw bracket and the tiller arm from between the second one of the yaw bracket and the tiller arm.

In independent examples disclosed herein, in a locked position the yaw lock is coupled to one of the yaw bracket and the tiller arm via a meshed engagement.

In independent examples disclosed herein, the yaw lock is movable back and forth along a lock axis into a locked position and an unlocked position, respectively.

In independent examples disclosed herein, the yaw lock is cammed into at least one of a locked position and an unlocked position.

In independent examples disclosed herein, the yaw lock is spring-biased into one of a locked position and an unlocked position.

In independent examples disclosed herein, the yaw lock includes a spring which biases the yaw lock towards an unlocked position and a cam which upon operation of the yaw lock cams the yaw lock into a locked position against the spring.

In independent examples disclosed herein, the yaw lock includes a jaw which is engaged with one of the yaw bracket and the tiller arm in a locked position and which is disengaged from the one of the yaw bracket and the tiller arm in an unlocked position In independent examples disclosed herein, the jaw includes a first plurality of teeth and the one of the yaw bracket and the tiller arm includes a second plurality of teeth. The first plurality of teeth are meshed with the second plurality of teeth when the yaw lock is in the locked position, and the first plurality of teeth are not meshed with the second plurality of teeth when the yaw lock is in the unlocked position.

In independent examples disclosed herein, the yaw lock includes a plunger which is slidable back and forth to bring the first plurality of teeth into and out of engagement with the second plurality of teeth.

In independent examples disclosed herein, the yaw lock includes a handle for manually operating the plunger and the jaw.

In independent examples disclosed herein, operation of the handle cams the jaw into engagement with the one of the yaw bracket and the tiller arm.

In independent examples disclosed herein, the plunger is spring-biased towards the unlocked position.

In independent examples disclosed herein, the yaw lock extends through the yaw bracket and the tiller arm.

In independent examples disclosed herein, the yaw lock includes a jaw configured to engage with one of the yaw bracket and steering bracket to lock the tiller arm in each of the plurality of yaw positions.

In independent examples disclosed herein, the yaw lock includes a plunger disposed in a through-bore extending through the yaw bracket and the tiller arm. The plunger is slidable back and forth in the through-bore to move the jaw into and out of engagement with the one of the yaw bracket and the tiller arm.

In independent examples disclosed herein, the yaw lock includes a handle configured to move the plunger back and forth in the through-bore.

In independent examples disclosed herein, the handle is pivotable into a locked position and an unlocked position, such that pivoting the handle into the locked position cams the jaw into engagement with the one of the yaw bracket and the tiller arm.

In independent examples disclosed herein, the handle is spring-biased towards the unlocked position.

BRIEF DESCRIPTION OF THE DRAWINGS

Embodiments are described with reference to the following drawing figures. The same numbers are used throughout to reference like features and components.

DETAILED DESCRIPTION

Figure 1:
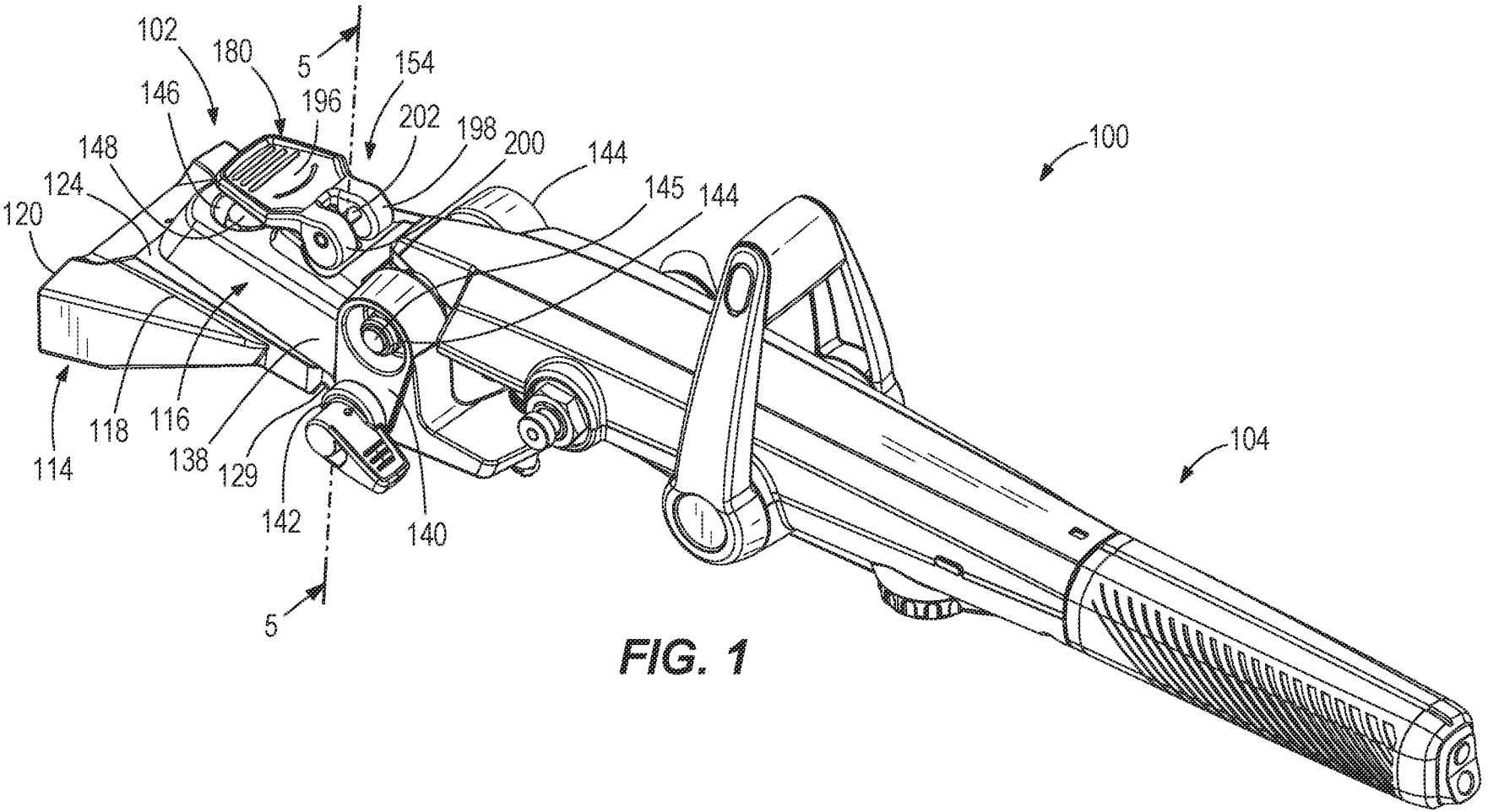
FIG. 1 is a perspective view looking down at a tiller according to the present disclosure.

FIG. 1 illustrates a tiller 100 for controlling a not-shown marine drive, such as an outboard motor. In general, the tiller 100 has a base bracket assembly 102 and a tiller arm 104 which is coupled to and extends outwardly from the base bracket assembly 102. The tiller 100 has several novel attributes which will be further explained herein below. Briefly, the base bracket assembly 102 is specially configured to facilitate yaw adjustment of the tiller arm 104, in particular into and between a variety of yaw positions relative to the marine drive. Further, the base bracket assembly 102 includes a novel yaw lock 154 configured to lock the tiller arm 104 in a plurality of yaw positions relative to the base bracket assembly 102 such that unlocking the yaw lock 154 facilitates movement of the tiller arm 104 into a new yaw position in the plurality of yaw positions. Shown in FIGS. 5-6, optionally the tiller 100 also may have a tilt mechanism 300, which advantageously facilitates selective retainment of the tiller arm 104 in any one of a range of user-selectable tilt positions relative to the tilt axis on the base bracket assembly 102.

Figure 2:
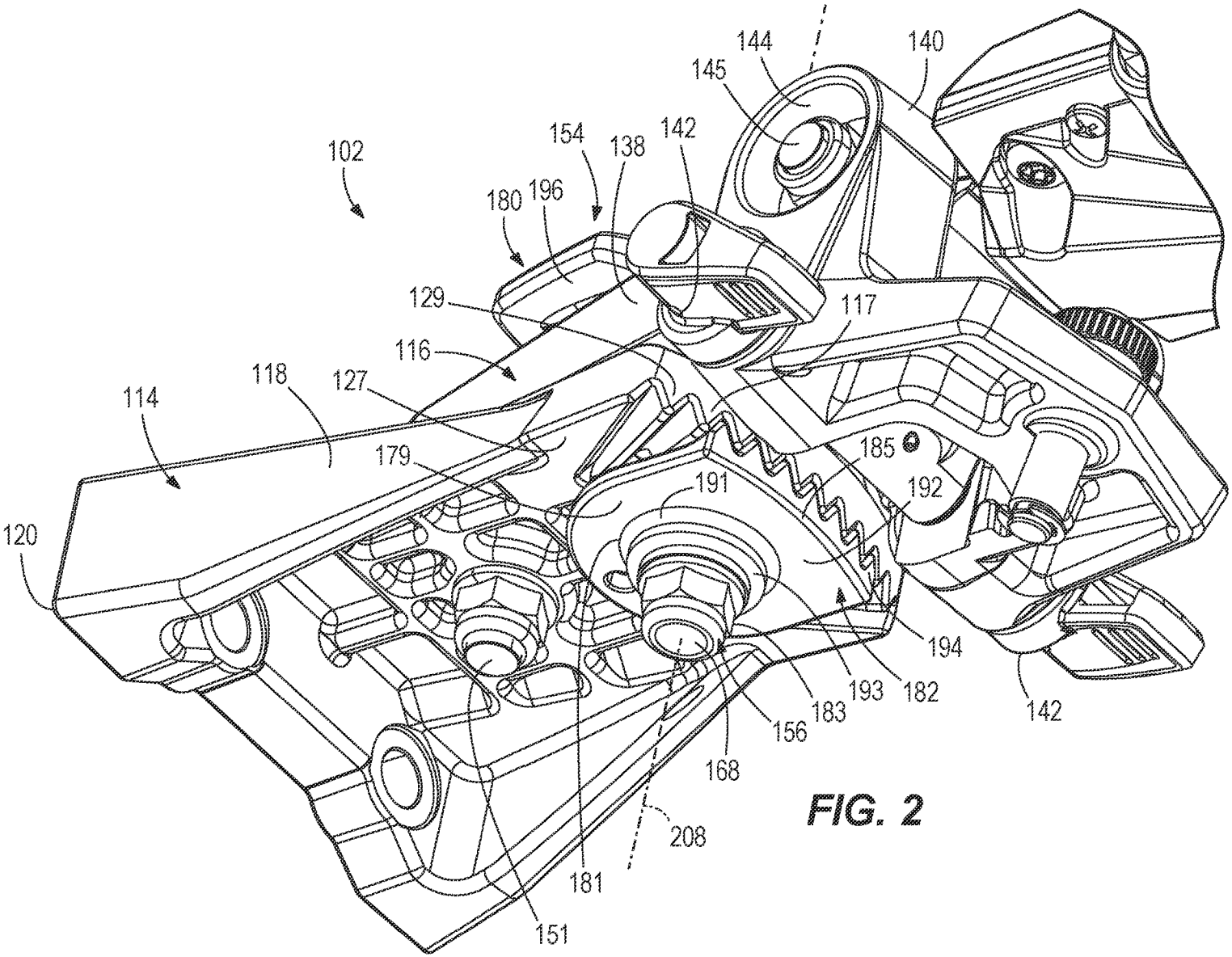
FIG. 2 is a perspective view looking up at a base bracket assembly.
Figure 3:
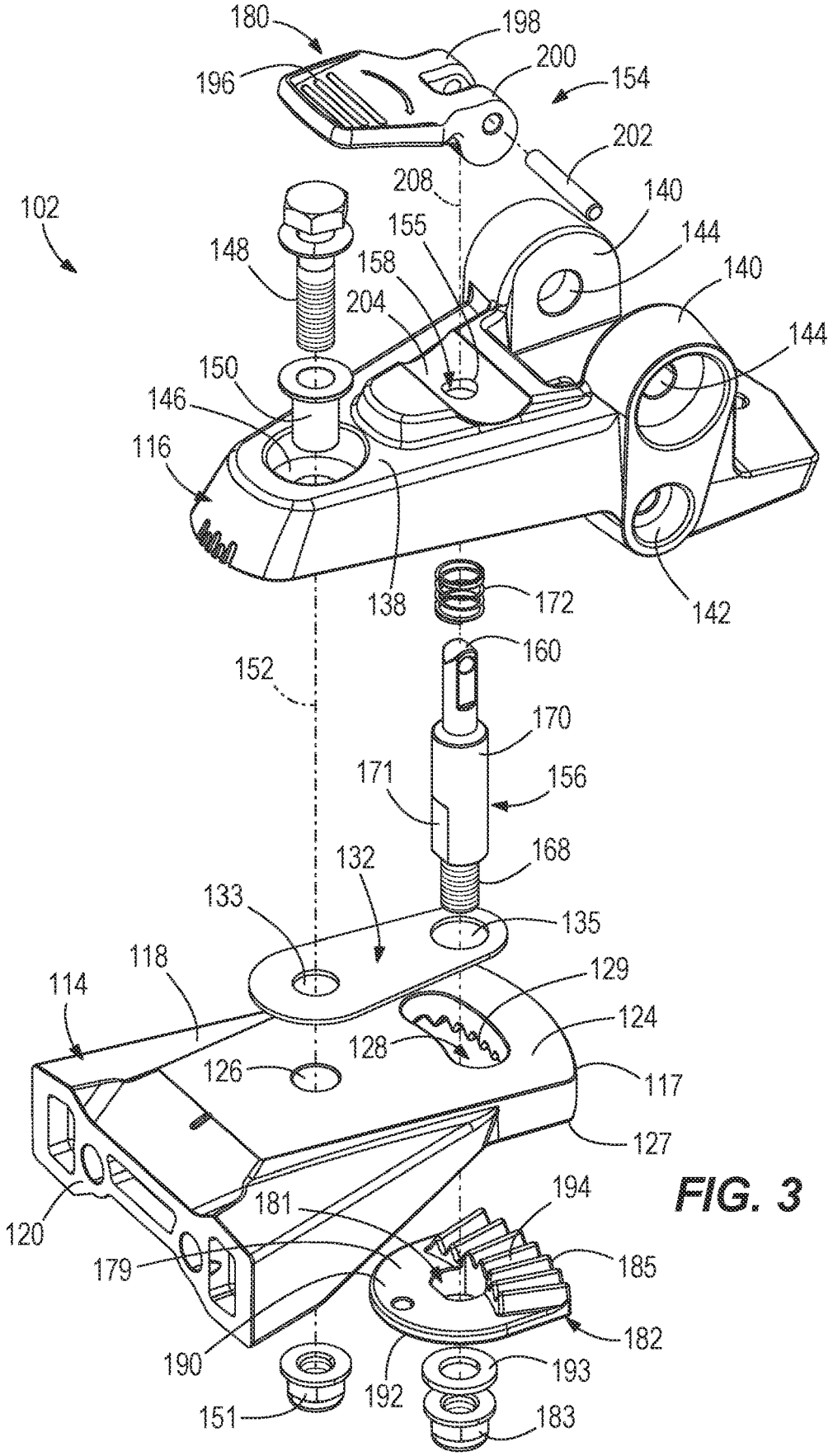
FIG. 3 is an exploded view of the base bracket assembly.
Figure 4:
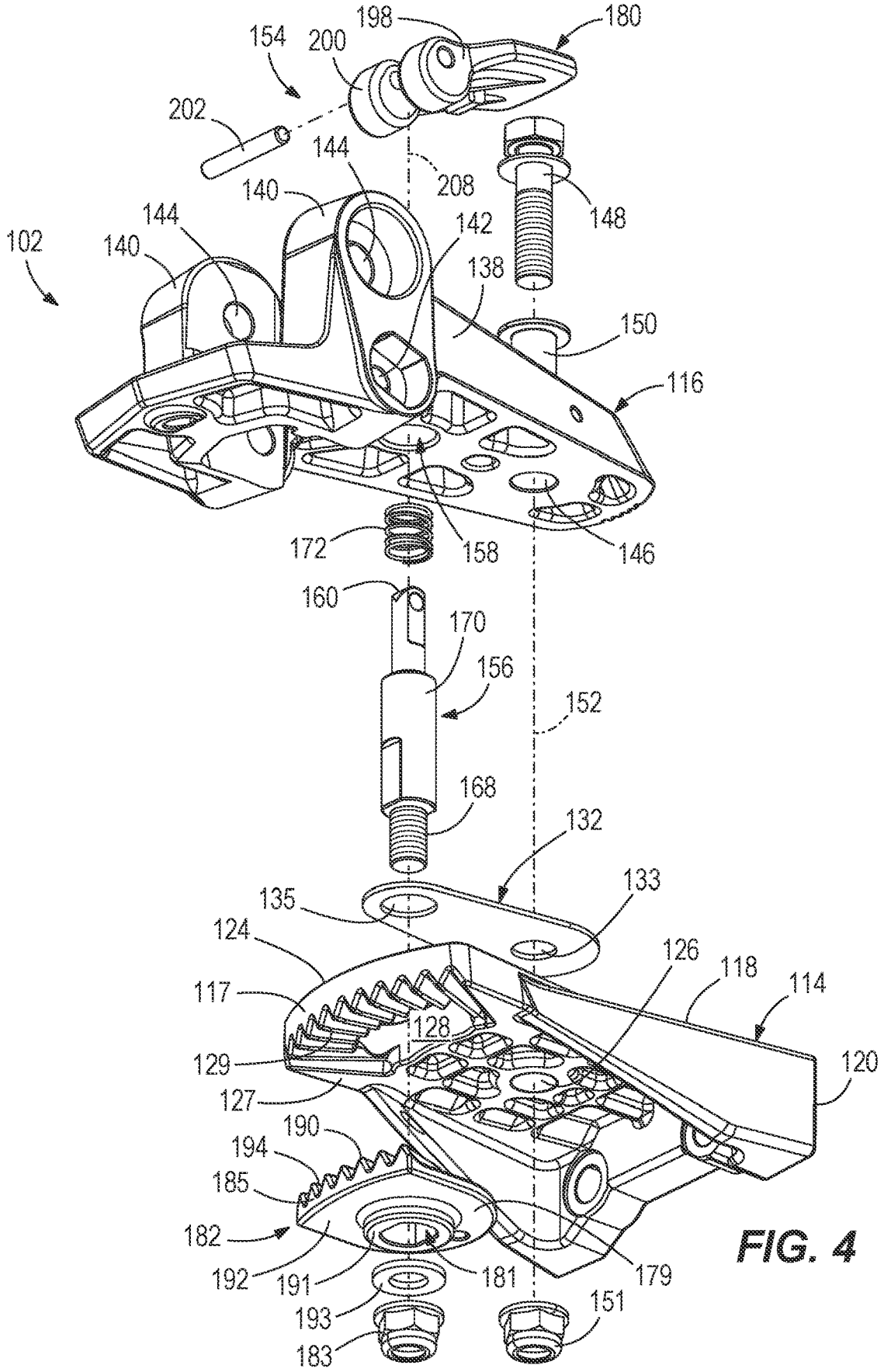
FIG. 4 is an exploded view looking up at the base bracket assembly.

Referring to FIGS. 2-4, the base bracket assembly 102 includes a yaw bracket 114 which is pivotably coupled to a steering bracket 116 of the tiller arm 104. The yaw bracket 114 is a rigid member having a body 118 and a base 120 which extends from the body 118 and is configured for fixed mounting to a not-shown steering arm of the marine drive. The body 118 of the yaw bracket 114 provides a pedestal 124 on an upper face of the body 118 upon which the steering bracket 116 is mounted. A through-bore 126 (FIG. 3) extends through the center portion of the pedestal 124, defining a yaw axis 152 about which the tiller arm 104 is pivotable relative to the yaw bracket 114. A pivot slot 128 is spaced apart from the through-bore 126 and extends through the pedestal 124. The pivot slot 128 is arc-shaped and spans fifteen degrees relative to the through-bore 126 in either direction. The pivot slot 128 defines a passage through the body 118 having a top opening on the pedestal 124 and a bottom opening on an underside 127 of the body 118. Engagement teeth 129 (FIG. 4) are arranged in an arc that extends outwardly from the underside 127 from the bottom opening toward a forward end 117 of the yaw bracket 114. Corresponding to the span of the pivot slot 128, the engagement teeth 129 span fifteen degrees relative to the through-bore 126 in either direction. A dual washer 132 is positioned on the pedestal 124. A first hole 133 of the dual washer 132 is aligned with the through-bore 126 and a second hole 135 is aligned with the pivot slot 128.

The steering bracket 116 is a rigid member having a body 138 and a pair of upwardly angled arms 140 having opposed lower through-bores 142 through the lower ends of the arms 140 and opposed through-bores 144 through the upper ends of the arms 140. A fastener 145 extends through the opposed through-bores 144 and through a corresponding through-bore 147 (not shown) in the tiller arm 104 so as to couple the tiller arm 104 to the steering bracket 116 in a way that the tiller arm 104 is tiltable up and down relative to the steering bracket 116. The fastener 145 defines a tilt axis about which the tiller arm 104 is pivotable relative to the base bracket assembly 102. Further description of the tilt mechanism shown in the drawings is presented in U.S. Patent Application No. 2023/0257092, which is incorporated by reference herein.

A through-bore 146 (FIG. 4) extends through the body 138. A fastener 148 extends along the yaw axis 152 through the through-bore 146, through the first hole 133 of the dual washer 132, through the through-bore 126 in the body 118 and into threaded engagement with a threaded bolt cap 151. The fastener 148 extends through a bearing 150 with a smooth outer surface, which is disposed in the through-bore 146, the washer 132 and the through-bore 126 when the fastener 148 is in its position of use. As such, the steering bracket 116 is rotatable in either direction relative to the yaw bracket 114 about the yaw axis 152. As explained above, the yaw bracket 114 is fixed to the steering arm of the marine drive and the steering bracket 116 is attached to the tiller arm 104. Thus, the tiller arm 104 and steering bracket 116 are pivotable together about the yaw axis 152 (FIG. 3) defined by the fastener 148 into and between a variety of yaw positions relative to the yaw bracket 114 and marine drive, as will be further described herein below.

Figure 6:
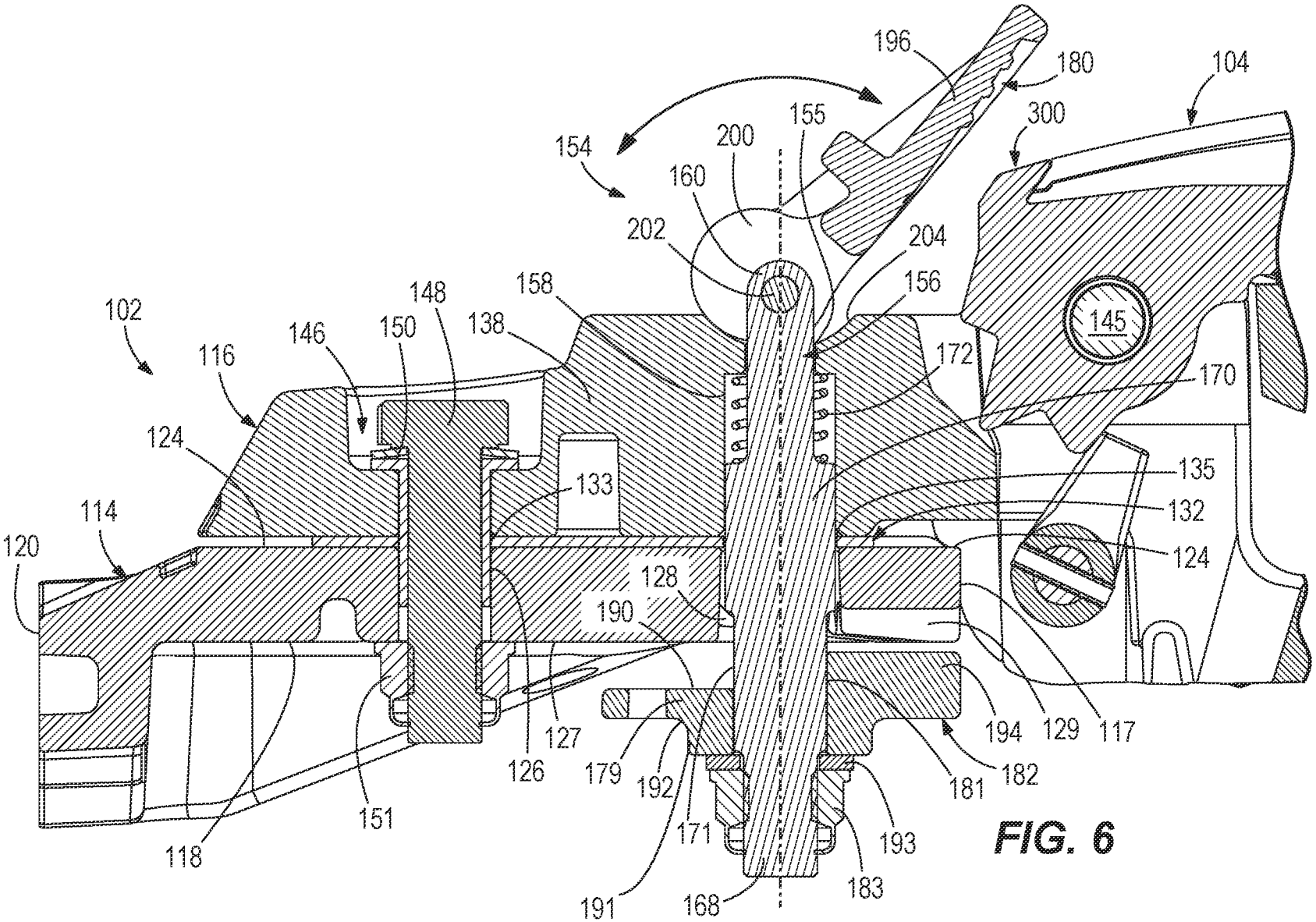
FIG. 6 is a section view of the base bracket assembly illustrating the yaw lock in an unlocked position.
Figure 7:
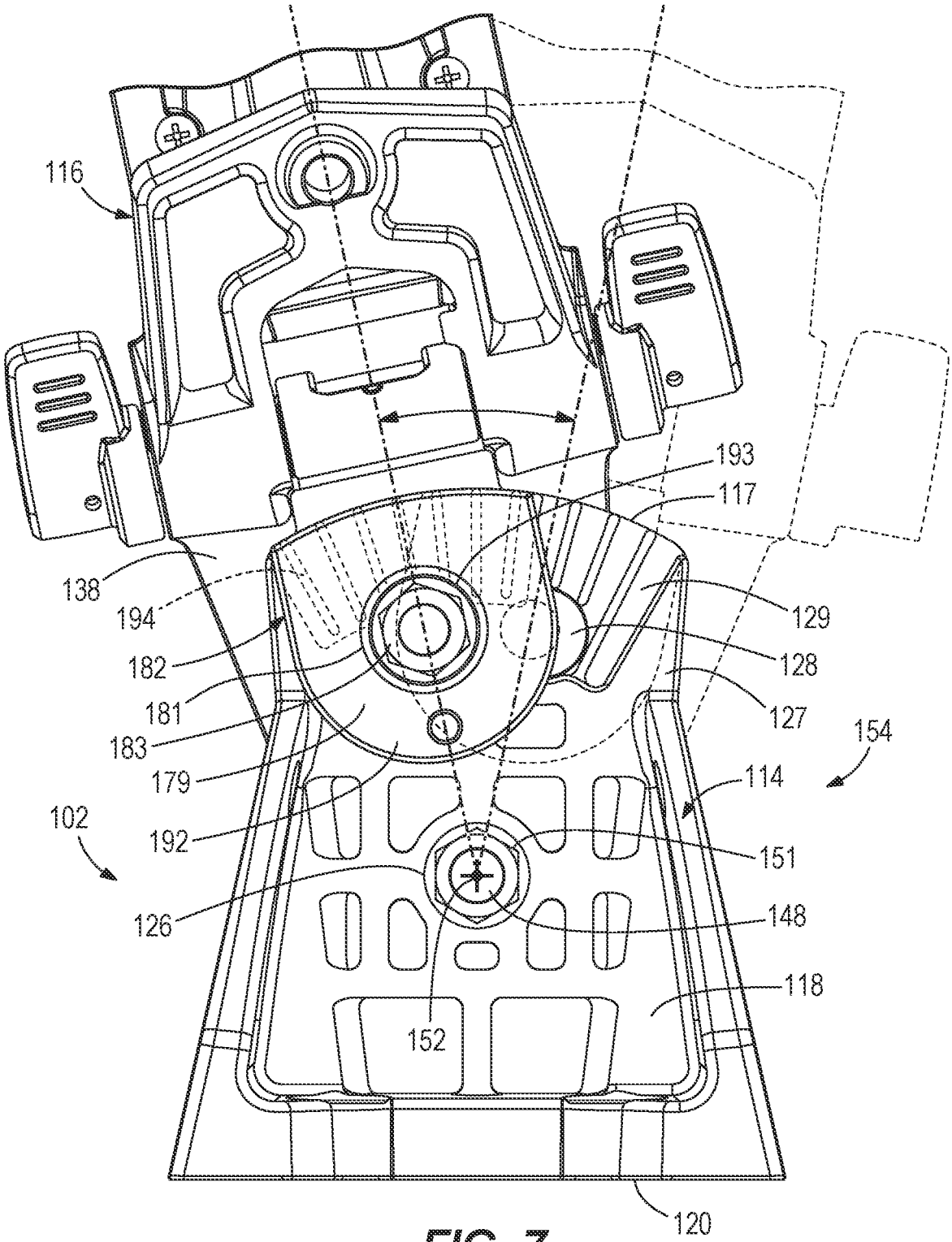
FIG. 7 is a perspective view looking up at the base bracket assembly, showing movements of the tiller partially in phantom.

Referring to FIGS. 3-4, a yaw lock 154 is specially configured to lock the tiller arm 104 and steering bracket 116 in a variety of yaw positions relative to the yaw bracket 114 and marine drive, as shown by arrows and phantom lines in FIG. 7. The yaw lock 154 is movable into a locked position (FIG. 5) in which the tiller arm 104 is prevented from pivoting about the yaw axis 152 relative to the yaw bracket 114, and further into an unlocked position (FIG. 6) in which the tiller arm 104 is pivotable about the yaw axis 152 relative to the yaw bracket 114.

The yaw lock 154 includes a plunger 156 which frictionally engages with a jaw 182. The plunger 156 resides in a through-bore 158 in the steering bracket 116 which defines an inner cavity, a bottom opening, and a top opening 155 which is smaller than the bottom opening. The plunger 156 extends along a lock axis 208 through the through-bore 158, through the second hole 135 in the washer 132, through the pivot slot 128, through a bore 181 in the jaw 182 and into threaded engagement with a threaded bolt cap 183.

The plunger 156 is an elongated member with a top end 160 which normally protrudes out of the top opening 155, a relatively enlarged annular body 170, and a threaded bottom end 168 which engages with the threaded bolt cap 183. The annular body 170 has a smooth outer surface with diametrically opposed flats 171 for frictionally engaging with corresponding flats of the bore 181 of the jaw 182. A coiled spring 172 is disposed between the top of the annular body 170 and the inside of the cavity adjacent to the top and normally biases the bottom end 168 of the plunger 156 outwardly relative to the bottom opening and into the position shown in FIG. 6.

The jaw 182 is disk-like with a body 179 having the bore 181 extending through a center thereof. A top face 190 engages with the underside of the yaw bracket 114 and a bottom face 192 includes a raised rim 191 extending annularly about the bore 181. A washer 193 is positioned between the jaw 182 and the threaded bolt cap 183. In a preferred embodiment, the washer 193 is a Belleville washer to provide a secure fitting, although this configuration is not limiting. The top face 190 includes radial teeth 194 for engagement with the yaw bracket 114 which splay outwardly from the bore 181 toward a front end 185 of the jaw 182.

The yaw lock 154 also includes a release lever 180 on top of the steering bracket 116 such that it is easily manually accessible from above and from the sides of the tiller 100. The release lever 180 has a handle 196 and first and second over-center cams 198, 200 which rotate together about a pin 202 extending therebetween. The cams 198, 200 are configured to retain their positioning in the locked position and the unlocked position. The handle 196 can be manually lifted by the operator's finger(s) to pivot the release lever 180 upwardly about the pivot axis defined by the pin 202 which cams the plunger 156 along the lock axis 208. The first and second cams 198, 200 are seated within an elongated recess 204 at the top opening 155 on the steering bracket 116. The top end 160 of the plunger 156 protrudes out of the top opening 155 and is pivotally coupled to the release lever 180 between the first and second cams 198, 200 via the pin 202. As described further herein, rotation of the release lever 180 about the pin 202 in a first direction shuttles the plunger 156 downward along the lock axis 208 and rotation of the release lever 180 about the pin 202 in a second direction opposite the first direction shuttles the plunger 156 upward along the lock axis 208.

Figure 5:
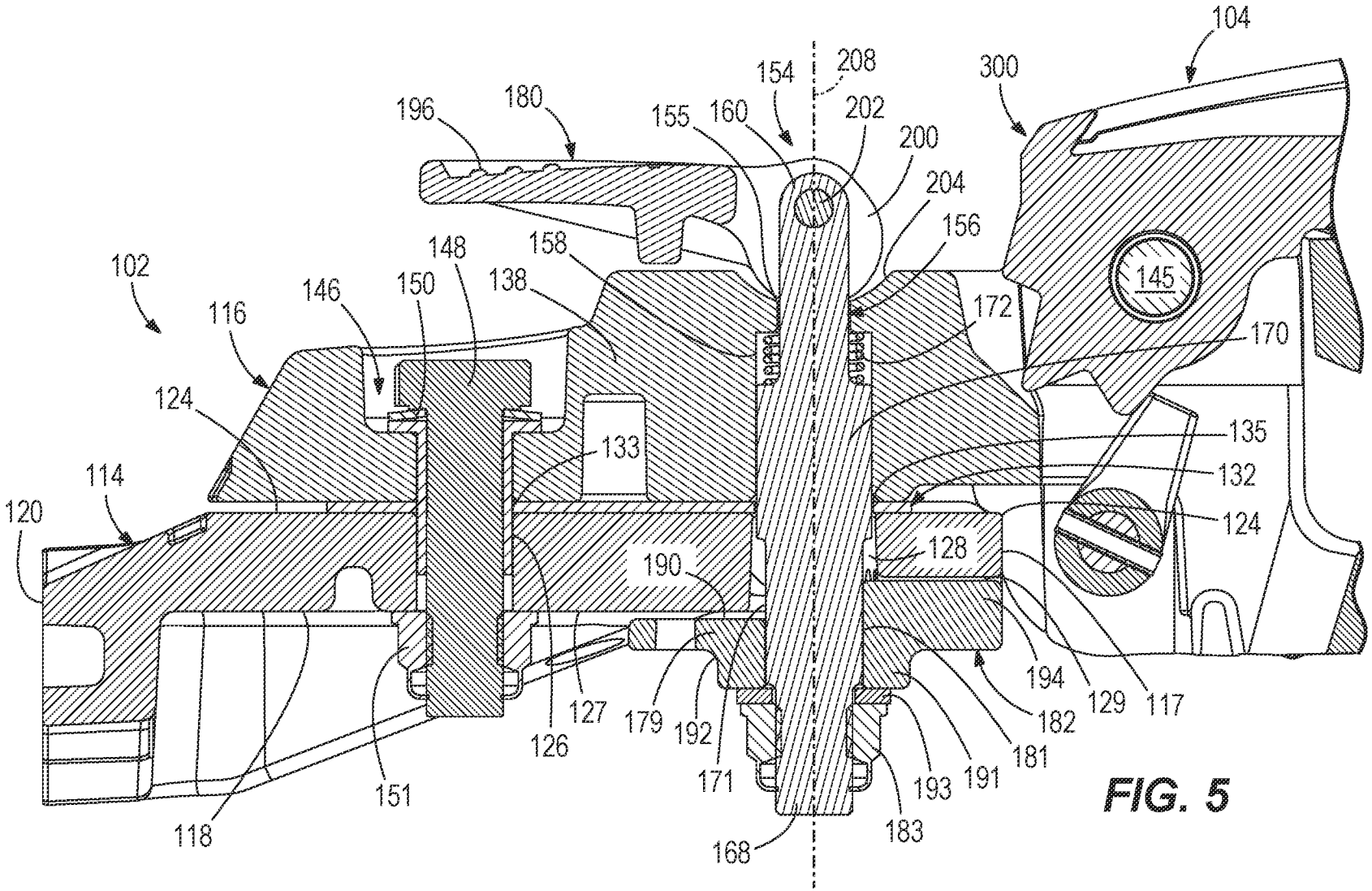
FIG. 5 is a section view of the base bracket assembly illustrating a yaw lock in a locked position.

The yaw lock 154 is movable via the first and second cams 198, 200 back and forth along the lock axis 208 into and between the locked position (FIG. 5) and the unlocked position (FIG. 6). FIG. 5 shows the yaw lock 154 in the locked position wherein the yaw bracket 114 is clamped between the jaw 182 and the steering bracket 116 of the tiller arm 104. In this position, the radial teeth 194 of the jaw 182 are meshed with the engagement teeth 129 of the yaw bracket 114 to prevent rotation of the tiller arm 104 relative to the yaw bracket 114. The coil spring 172 biases the bottom end 168 of the plunger 156 toward the unlocked position and provides tension between the release lever 180 and the plunger 156.

As shown by arrows in FIG. 6, to change the yaw position of the tiller 100 relative to the marine drive, the user moves the yaw lock 154 into the unlocked position. In the unlocked position, the yaw lock 154 unclamps the yaw bracket 114 from the steering bracket 116 which frees the steering bracket 116 and tiller arm 104 for pivoting motion about the yaw axis 152 (FIG. 3) relative to the yaw bracket 114 and marine drive. To move the yaw lock 154 into the unlocked position, the user manually pivots the first end of the release lever 180 upwardly relative to the pin 202, which rotates the cams 198, 200 and thus moves the plunger 156 downwardly. As this occurs, the jaw 182 disengages from the yaw bracket 114 and the user is free to pivot the steering bracket 116 into a new yaw position in the plurality of yaw positions. As discussed above, in the illustrated embodiment, the steering bracket 116 is pivotable through thirty degrees relative to the yaw axis 152, as shown in FIG. 7, and lockable into various yaw positions designated by the engagement teeth 129.

To move the yaw lock 154 into the locked position, the user can rotate the release lever 180 downwardly, which rotates the cams 198, 200 against the bias of the coil spring 172 and shuttles the plunger 156 upwardly. As this occurs, the radial teeth of the jaw 182 mesh with the engagement teeth 129 of the yaw bracket 114. As such, it will be understood that unlocking the yaw lock 154 advantageously facilitates movement of the tiller arm 104 along the path shown in FIG. 7 and into a new yaw position relative to the marine drive. In the non-limiting illustrated embodiment, the tiller arm 104 and steering bracket 116 are pivotable through thirty degrees relative to the yaw bracket 114.

In alternative examples, the base bracket assembly 102 may be configured such that the yaw lock 154 extends first through the yaw bracket 114 and second through the steering bracket 116 of the tiller arm 104 such that in a locked position the yaw lock 154 clamps the tiller arm 104 between the jaw 182 and the yaw bracket 114. It is conceivable that the jaw 182 is positioned above or below the yaw bracket 114 or the steering bracket 116 such that the yaw lock 154 is movable along the lock axis 208 into and out of meshed engagement with one of the yaw bracket 114 and the steering bracket 116.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

The invention claimed is:

1. A tiller for steering a marine drive relative to a marine vessel, the tiller comprising:

a yaw bracket configured for attachment to the marine drive;

a tiller arm which is pivotable about a yaw axis relative to the yaw bracket; and a yaw lock configured to lock the tiller arm in a plurality of yaw positions relative to the yaw bracket, wherein unlocking the yaw lock facilitates movement of the tiller arm into a new yaw position in the plurality of yaw positions, wherein the yaw lock comprises a spring which biases the yaw lock towards an unlocked position and a cam which upon operation of the yaw lock cams the yaw lock into a locked position against the spring.

2. The tiller according to claim 1, wherein the yaw lock is movable into a locked position in which the tiller arm is prevented from pivoting about the yaw axis relative to the yaw bracket, and further wherein the yaw lock is movable into an unlocked position in which the tiller arm is pivotable about the yaw axis relative to the yaw bracket.

3. The tiller according to claim 1, wherein in a locked position the yaw lock clamps a first one of the yaw bracket and the tiller arm between a second one of the yaw bracket and the tiller arm, and wherein in an unlocked position the yaw lock unclamps the first one of the yaw bracket and the tiller arm from between the second one of the yaw bracket and the tiller arm.

4. The tiller according to claim 1, wherein in a locked position the yaw lock is coupled to one of the yaw bracket and the tiller arm via a meshed engagement.

5. The tiller according to claim 1, wherein the yaw lock is movable back and forth along a lock axis into a locked position and an unlocked position, respectively.

6. The tiller according to claim 1, wherein the yaw lock is cammed into at least one of a locked position and an unlocked position.

7. The tiller according to claim 1, wherein the yaw lock is spring-biased into one of a locked position and an unlocked position.

8. The tiller according to claim 1, wherein the yaw lock comprises a jaw which is engaged with one of the yaw bracket and the tiller arm in a locked position and which is disengaged from the one of the yaw bracket and the tiller arm in an unlocked position.

9. The tiller according to claim 8, wherein the jaw comprises a first plurality of teeth and wherein the one of the yaw bracket and the tiller arm comprises a second plurality of teeth; and further wherein the first plurality of teeth are meshed with the second plurality of teeth when the yaw lock is in the locked position, and the first plurality of teeth are not meshed with the second plurality of teeth when the yaw lock is in the unlocked position.

10. The tiller according to claim 1, wherein the yaw lock extends through the yaw bracket and the tiller arm.

11. The tiller according to claim 10, wherein the yaw lock comprises a jaw configured to engage with one of the yaw bracket and steering bracket to lock the tiller arm in each of the plurality of yaw positions.

12. A tiller for steering a marine drive relative to a marine vessel, the tiller comprising:

a yaw bracket configured for attachment to the marine drive;

a tiller arm which is pivotable about a yaw axis relative to the yaw bracket; and a yaw lock configured to lock the tiller arm in a plurality of yaw positions relative to the yaw bracket, wherein unlocking the yaw lock facilitates movement of the tiller arm into a new yaw position in the plurality of yaw positions;

wherein the yaw lock comprises a jaw which is engaged with one of the yaw bracket and the tiller arm in a locked position and which is disengaged from the one of the yaw bracket and the tiller arm in an unlocked position, wherein the jaw comprises a first plurality of teeth and wherein the one of the yaw bracket and the tiller arm comprises a second plurality of teeth; and further wherein the first plurality of teeth are meshed with the second plurality of teeth when the yaw lock is in the locked position, and the first plurality of teeth are not meshed with the second plurality of teeth when the yaw lock is in the unlocked position, and wherein the yaw lock further comprises a plunger which is slidable back and forth to bring the first plurality of teeth into and out of engagement with the second plurality of teeth.

13. The tiller according to claim 12, wherein the yaw lock comprises a spring which biases the yaw lock towards an unlocked position and a cam which upon operation of the yaw lock cams the yaw lock into a locked position against the spring.

14. The tiller according to claim 12, wherein the yaw lock further comprises a handle for manually operating the plunger and the jaw.

15. The tiller according to claim 14, wherein operation of the handle cams the jaw into engagement with the one of the yaw bracket and the tiller arm.

16. The tiller according to claim 14, wherein the plunger is spring-biased towards the unlocked position.

17. A tiller for steering a marine drive relative to a marine vessel, the tiller comprising:

a yaw bracket configured for attachment to the marine drive;

a tiller arm which is pivotable about a yaw axis relative to the yaw bracket; and a yaw lock configured to lock the tiller arm in a plurality of yaw positions relative to the yaw bracket, wherein unlocking the yaw lock facilitates movement of the tiller arm into a new yaw position in the plurality of yaw positions;

wherein the yaw lock extends through the yaw bracket and the tiller arm and comprises a jaw configured to engage with one of the yaw bracket and steering bracket to lock the tiller arm in each of the plurality of yaw positions, and wherein the yaw lock further comprises a plunger disposed in a through-bore extending through the yaw bracket and the tiller arm, wherein the plunger is slidable back and forth in the through-bore to move the jaw into and out of engagement with the one of the yaw bracket and the tiller arm.

18. The tiller according to claim 17, wherein the yaw lock comprises a handle configured to move the plunger back and forth in the through-bore.

19. The tiller according to claim 18, wherein the handle is pivotable into a locked position and an unlocked position, and wherein pivoting the handle into the locked position cams the jaw into engagement with the one of the yaw bracket and the tiller arm.

20. The tiller according to claim 19, wherein the handle is spring-biased towards the unlocked position.

* * * * *